US007778581B2

(12) United States Patent
Seo et al.

(10) Patent No.: US 7,778,581 B2
(45) Date of Patent: Aug. 17, 2010

(54) FIXING UNIT HAVING ENHANCED HEATING EFFICIENCY AND IMAGE FORMING APPARATUS USING THE SAME

(75) Inventors: Hiroshi Seo, Sagamihara (JP); Akiko Ito, Machida (JP); Tadashi Ogawa, Machida (JP)

(73) Assignee: Ricoh Company, Ltd., Tokyo (JP)

( * ) Notice: Subject to any disclaimer, the term of this patent is extended or adjusted under 35 U.S.C. 154(b) by 19 days.

(21) Appl. No.: 11/831,013

(22) Filed: Jul. 31, 2007

(65) Prior Publication Data

US 2008/0025772 A1 Jan. 31, 2008

(30) Foreign Application Priority Data

Jul. 31, 2006 (JP) ..... 2006-207613

(51) Int. Cl.
*G03G 15/20* (2006.01)

(52) U.S. Cl. ..... 399/328; 399/320; 399/330; 399/334; 399/335

(58) Field of Classification Search ..... 399/320, 399/328, 330, 334, 335
See application file for complete search history.

(56) References Cited

U.S. PATENT DOCUMENTS

2004/0033092 A1* 2/2004 Aruga ..... 399/329
2004/0081490 A1* 4/2004 Terada et al. ..... 399/328
2006/0210330 A1* 9/2006 Sone et al. ..... 399/328

FOREIGN PATENT DOCUMENTS

JP 2005-070376 3/2005

* cited by examiner

*Primary Examiner*—Stephen D Meier
*Assistant Examiner*—Ryan D Walsh
(74) *Attorney, Agent, or Firm*—Harness, Dickey & Pierce, P.L.C.

(57) ABSTRACT

A fixing unit includes: a shaft; a heatable rotating member, mounted for rotation on the shaft, for fixing an image on a recording medium, the heatable rotating member having a heat generating layer heatable via a magnetic flux; a magnetic flux generator configured to generate the magnetic flux, the magnetic flux generator being provided proximal to the heatable rotating member; and a supporting frame having a shaft supporter configured to support an end of the shaft on which the heatable rotating member is mounted, the shaft supporter being positioned outside of an end portion of the magnetic flux generator.

19 Claims, 18 Drawing Sheets

FIXING UNIT HAVING ENHANCED HEATING EFFICIENCY AND IMAGE FORMING APPARATUS USING THE SAME

PRIORITY STATEMENT

The present patent application claims priority under 35 U.S.C. §119 upon Japanese patent application No. 2006-207613, filed on Jul. 31, 2006, in the Japan Patent Office, the entire contents of which are incorporated by reference herein.

TECHNICAL FIELD

The present disclosure relates to a fixing unit for an image forming apparatus, and more particularly, to a fixing unit using electromagnetic induction heating method.

BACKGROUND

An image forming apparatus such as copying machine, printer, facsimile, printing machine, and multi-functional apparatus may produce an image by transferring a visible image (e.g., toner image) from an image carrier to a recording sheet.

Such visible image (e.g., toner image) may be fixed on a recording sheet by applying heat and pressure to the recording sheet when the recording sheet passes through a fixing unit.

Such fixing unit may employ a heat roller type or a belt fixing type as heat applying method, for example.

The heat roller type may include a heating roller having a heat source (e.g., halogen lamp) and a pressure roller contactable to the heating roller, wherein heating roller and the pressure roller may form a fixing nip therebetween.

The belt fixing type may include a belt as heat applying member, wherein the belt may have a heat capacitance smaller than a roller.

Further, a fixing unit may employ an electromagnetic induction heating method as heat applying method.

In such electromagnetic induction heating method, a heating roller may include an induction coil therein. When an electric current is applied to the induction coil, an eddy current may be induced in the heating roller with an effect of magnetic field generated by the induction coil, by which the heating roller may be heated.

Such configuration may not need a preheating process for the heating roller, which may be conducted for conventional heat roller type. Accordingly, such electromagnetic induction heating method may preferably increase a temperature of the heating roller to a given temperature instantaneously.

SUMMARY

An embodiment of the present invention provides a fixing unit comprising: a shaft; a heatable rotating member, mounted for rotation on the shaft, for fixing an image on a recording medium, the heatable rotating member having a heat generating layer heatable via a magnetic flux; a magnetic flux generator configured to generate the magnetic flux, the magnetic flux generator being provided proximal to the heatable rotating member; and a supporting frame having a shaft supporter configured to support an end of the shaft on which the heatable rotating member is mounted, the shaft supporter being positioned outside of an end portion of the magnetic flux generator.

An embodiment of the present invention provides an image forming apparatus comprising: a photoconductive member; a toner image forming unit to form a toner image on the photoconductive member; a transfer unit to transfer the toner image from the photoconductive member to a recording medium; and a fixing unit such as described above.

Additional features and advantages of the present invention will be more fully apparent from the following detailed description of example embodiments, the accompanying drawings and the associated claims.

BRIEF DESCRIPTION OF DRAWINGS

A more complete appreciation of the disclosure and many of the attendant advantages and features thereof can be readily obtained and understood from the following detailed description with reference to the accompanying drawings, wherein.

Figure 1:
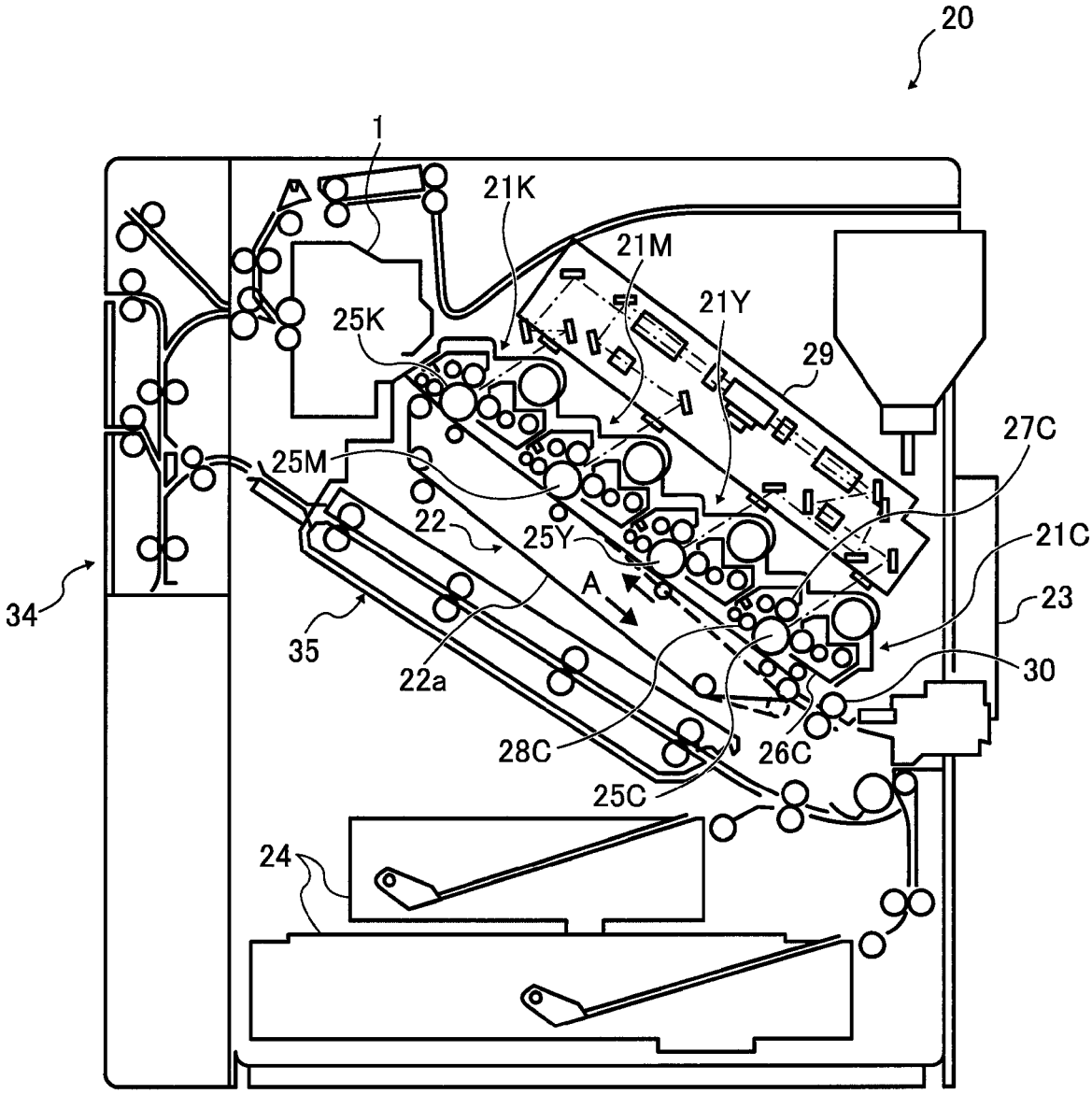
FIG. 1 is a schematic configuration of an image forming apparatus having a fixing unit according to an example embodiment of the present invention.

The accompanying drawings are intended to depict example embodiments of the present disclosure and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on," "against," "connected to" or "coupled to" another element or layer, then it can be directly on, against connected or coupled to the other element or layer, or intervening elements or layers may be present. In contrast, if an element is referred to as being "directly on", "directly connected to" or "directly coupled to" another element or layer, then there is no intervening elements or layers present.

Like numbers refer to like elements throughout. As used herein, the term "and/or" includes any and all combinations of one or more of the associated listed items.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner.

Referring now to the drawings, wherein like reference numerals designate identical or corresponding parts throughout the several views, an image forming apparatus according to an example embodiment is described with particular reference to FIG. 1.

FIG. 1 shows an image forming apparatus 20 having a fixing unit according to an example embodiment. Although the image forming apparatus 20 includes a copying machine or printer having four processing units arranged in a tandem manner for full color image forming, the image forming apparatus 20 may also include other types of machines such as monochrome image forming machine, for example.

The image forming apparatus 20 shown in FIG. 1 may employ a direct image forming method, for example. In such direct image forming method, each color image may be formed as a latent image on each image carrier and developed as visible image (e.g., toner color image), and then such visible image for each color may be superimposingly transferred to a recording sheet, transported by a transport belt.

As shown in FIG. 1, the image forming apparatus 20 may include image forming units 21Y, 21M, 21C, 21K, a transfer unit 22, a manual feed tray 23, a sheet cassette 24, a registration roller 30, and a fixing unit 1, for example.

The image forming unit 21Y, 21M, 21C, 21K may form respective color image corresponding to an original document image. Hereinafter, Y, M, C, and K represent color of yellow, magenta, cyan, and black, respectively.

The transfer unit 22 may face each of the image forming units 21Y, 21M, 21C, and 21K, and may form an image transfer nip with each of the image forming units 21Y, 21M, 21C, and 21K.

The manual feed tray 23 may be used to feed a sheet in a manual mode. The sheet cassette 24 may have two cassettes, for example, as shown in FIG. 1.

The registration roller 30 may feed a recording sheet, transported from the sheet cassette 24, to an image transfer nip for each of the image forming unit 21Y, 21M, 21C, and 21K with adjusting such sheet feed timing with an image forming timing of each of the image forming unit 21Y, 21M, 21C, and 21K.

The fixing unit 1 may fix images on the recording sheet, which may be transferred with visible images (e.g., toner images) at the image transfer nip. In an example embodiment, the fixing unit 1 may fix toner images on a recording sheet having an unfixed toner images thereon.

In addition to such fixing method, an image forming apparatus according to an example embodiment may employ a trans-fix unit, which may transfer toner images on a recording sheet and fix the toner images on the recording sheet at a substantially same timing, for example.

The fixing unit 1, to be described later, may have a configuration having a pair of rollers used for fixing an image (e.g., toner image) on a recording sheet. Specifically, the fixing unit 1 may include a fixing roller and a pressure roller, for example. The fixing roller may have a heat source therein, and the pressure roller may apply pressure to the fixing roller by contacting the fixing roller.

The transfer unit 22 may include a transport belt 22*a*, a transfer biasing voltage applier (not shown), and an adsorption bias voltage applier, for example.

The transport belt 22*a*, extended by a plurality of rollers, may transport a recording sheet by adsorbing the sheet on the transport belt 22*a*.

The transfer biasing voltage applier (not shown), disposed at a position facing a photoconductor drum for each of the image forming units 21, may apply transfer biasing voltage to the recording sheet.

Furthermore, the adsorption bias voltage applier may be disposed at a sheet entrance side of the transfer unit 22. Such adsorption bias voltage applier may apply adsorption bias voltage to a recording sheet to adhere the recording sheet on the transport belt 22*a*.

The transport belt 22*a*, having the recording sheet thereon, may travel in a direction shown by an arrow A in FIG. 1, and the recording sheet may be transferred with toner images from the image forming unit 21Y, 21M, 21C, and 21K during such traveling.

The image forming units 21Y, 21M, 21C, and 21K may conduct a developing process for images of yellow, magenta, cyan, and black, respectively, and may have a similar configuration one another. Accordingly, the image forming unit 21C may be explained as a representative of the image forming units 21Y, 21M, 21C, and 21K, hereinafter.

The image forming unit 21C may include a photoconductor drum 25C, a developing unit 26C, a charging unit 27C, and a cleaning unit 28C, for example.

The photoconductor drum 25C may be used as image carrier, which carries an electrostatic latent image thereon. An image carrier having a belt shape may also be used instead of drum shape.

As shown in FIG. 1, the charging unit 27C, the developing unit 26C, and the cleaning unit 28C may be disposed around the photoconductor drum 25C.

The charging unit 27C may charge the surface of the photoconductor drum 25C uniformly.

A writing unit 29 may emit a light beam to the charged photoconductor drum 25C to write an electrostatic latent image on the charged photoconductor drum 25C corresponding to image data.

The developing unit 26C may develop the electrostatic latent image as visible image (e.g., toner image) on the photoconductor drum 25C.

As shown in FIG. 1, the transfer unit 22 may be installed in the image forming apparatus 20 in a slanted manner, by which an occupying space of image forming apparatus 20 in a horizontal direction may be reduced.

In such configured image forming apparatus 20, an image forming operation may be conducted as below. Hereinafter, an image forming operation may be explained with the image forming unit 21C using cyan toner. Other image forming units may similarly conduct image forming operations.

A main motor (not shown) may drive the photoconductor drum 25C. The photoconductor drum 25C, rotated by the main motor (not shown), may be de-charged by a de-charger (not shown), and a surface potential of photoconductor drum 25C may be set to a reference potential such as approximately −50V.

Then, the charging unit 27C may apply AC bias voltage, superimposed with DC bias voltage, to the photoconductor drum 25C to uniformly charge the surface potential of the photoconductor drum 25C to a given charging potential such as −500V to −700V. Such given charging potential may be determined by a process controlling unit.

The writing unit 29 may irradiate a laser beam to write an electrostatic latent image on the photoconductor drum 25C, charged uniformly by the above-mentioned charging process. The writing unit 29 may write an electrostatic latent image corresponding to image information transmitted from an image controller (not shown). The writing unit 29 may include a light source, a polygon mirror, an f-theta lens, for example.

The light source may emit a laser beam corresponding to image information transmitted from the image controller. The light source may include a laser diode, for example.

The laser beam, passing a cylinder lens, polygon mirror, f-theta lens, mirrors, and other lens, may irradiate a surface of the photoconductor drum 25C.

Such photoconductor drum 25C may then have a surface area having a surface potential of approximately −50V by such irradiation, by which an electrostatic latent image corresponding to the image information may be formed on the photoconductor drum 25C.

The developing unit 26C may develop the electrostatic latent image on the photoconductor drum 25C with toners as visible image. In the developing process, a developing sleeve of the developing unit 26C may be applied with DC −300V to −500V superimposed with AC bias voltage.

The developing unit 26C may develop a toner image having a given charge (e.g., Q/M: −20 μC/g to −30 μC/g) on an area having a relatively lower potential due to the irradiation of light beam.

The toner image developed by such developing process may be transferred to a recording sheet. The recording sheet may be fed to an image transferring nip by the registration roller 30. The registration roller 30 may temporarily stop a movement of the recording sheet before feeding the recording sheet to the image transferring nip.

The recording sheet may be applied with an adsorption bias voltage by the adsorption bias voltage applier, which may be disposed at a sheet entry side of the transport belt 22*a*. The adsorption bias voltage applier may be configured as roller unit. With such process, the recording sheet may be electrostatically adsorbed on the transport belt 22*a*. The recording sheet adsorbed on the transport belt 22*a* may travel with the transport belt 22*a* in a direction show by an arrow A in FIG. 1.

When the recording sheet comes to a position facing a photoconductor drum 25 of each image forming unit 21, the transfer biasing voltage applier may apply bias voltage, which has an opposite polarity of toner, to the recording sheet to electrostatically transfer the toner image from the photoconductor drum 25.

After such image transferring operation is finished, the recording sheet may be separated from the transport belt 22*a*, and transported to the fixing unit 1.

The fixing unit 1 may include a fixing roller and a pressure roller, which may configure a fixing nip therebetween. When the recording sheet passes through the fixing nip, toner images may be fixed on the recording sheet.

After the toner image is fixed on the recording sheet, the recording sheet may be ejected to an in-apparatus ejection tray or to an outer ejection tray (not shown). The in-apparatus ejection tray may mean a space provided in a body of an image forming apparatus. Because such in-apparatus ejection tray may not protrude from the body of an image forming apparatus, an occupying space of such image forming apparatus having in-apparatus ejection tray may be reduced.

The image forming apparatus 20 shown in FIG. 1 may have a configuration that can form an image on both faces of recording sheet.

As shown in FIG. 1, the image forming apparatus 20 may include a double-face reversing unit 34 and a reversing transport unit 35. When a double-face image forming mode may be selected, the recording sheet passed through the fixing unit 1 may be transported to the double-face reversing unit 34, in which a face orientation of the recording sheet may be reversed, and then the recording sheet may be transported to the reversing transport unit 35.

The recording sheet may be further transported to the registration roller 30, as similar to one-face image forming, and then the registration roller 30 may feed the recording sheet to the image transfer nip at a given timing.

The recording sheet having images on both faces may pass through the fixing unit 1, and then may be ejected to the above-mentioned sheet ejection tray as similar to the one-face image forming.

Figure 2:
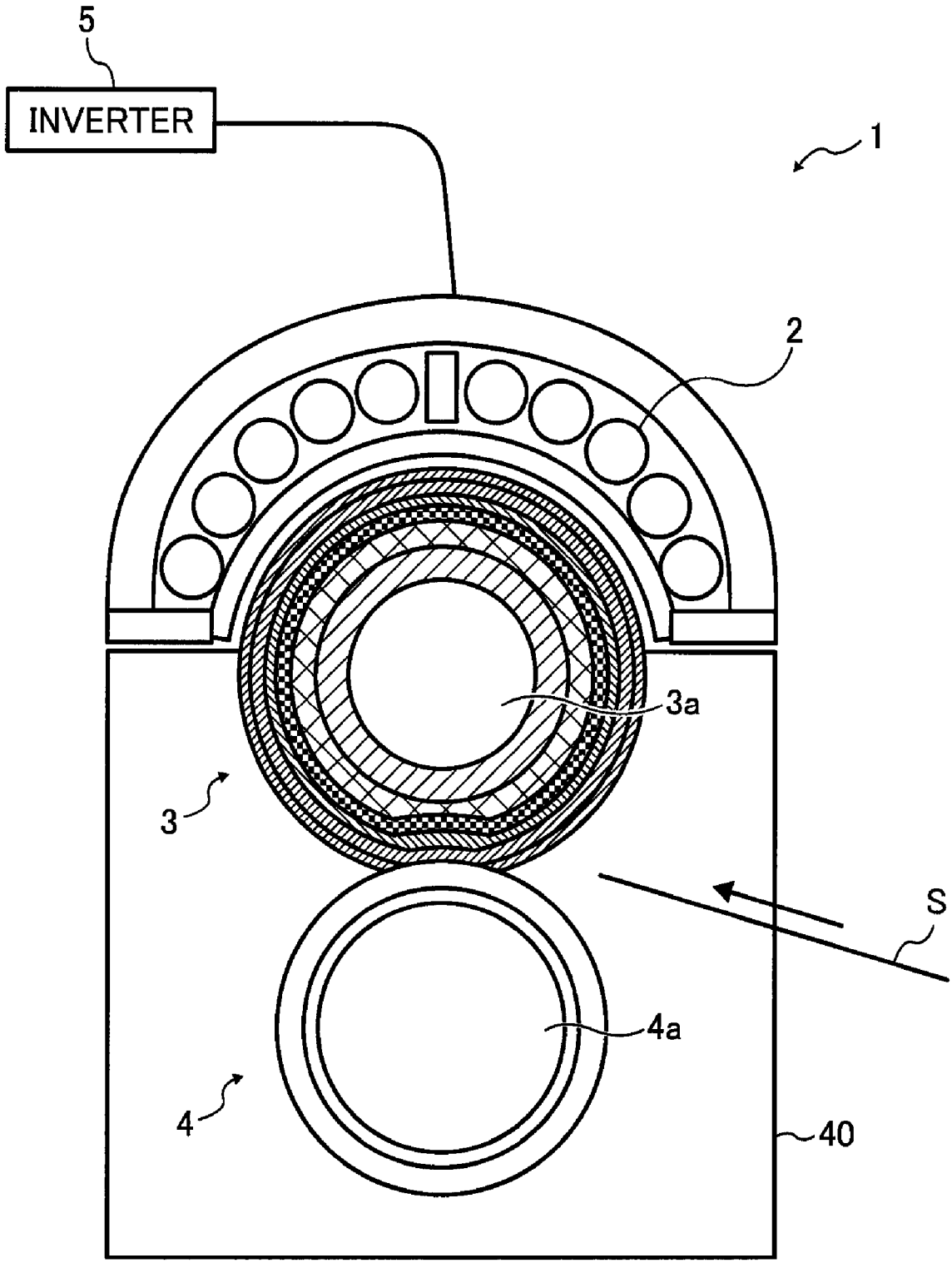
FIG. 2 is a schematic cross-sectional view of a fixing unit according to an example embodiment of the present invention.

FIG. 2 illustrates a schematic cross-sectional view of the fixing unit 1 used in the image forming apparatus 20. The fixing unit 1 may be configured with rollers, for example.

As shown in FIG. 2, the fixing unit 1 may include an external coil 2, a fixing roller 3, a pressure roller 4, an inverter 5, for example. The fixing unit 1 may be used to fix an image on a recording medium S.

The external coil 2 may generate magnetic flux when electric current flows the coil.

The fixing roller 3 may be a fixing member of rotating type, which may include a metal material, for example. The pressure roller 4 may be a pressure applying member of rotating type.

In the fixing unit 1, the inverter 5 used as induction heating circuit may drive the flux generator 2 with high frequency wave to generate a magnetic field having a high frequency wave.

Such magnetic field may induce an eddy current on the fixing roller 3, including metal material, by which a temperature of the fixing roller 3 may be increased. That is, such a magnetic field inductively heats the fixing roller 3.

Furthermore, the fixing roller 3 used as heatable rotating member may have a shaft 3*a*, and the pressure roller 4 used as pressure applying member may have a shaft 4*a* as shown in FIG. 2. A supporting frame 40 may support both ends of the shaft 3*a* of the fixing roller 3 and both ends of the shaft 4*a* of the pressure roller 4.

The supporting frame 40 may be formed of a material including metal material, which may include magnetic material, for example.

Figure 3:
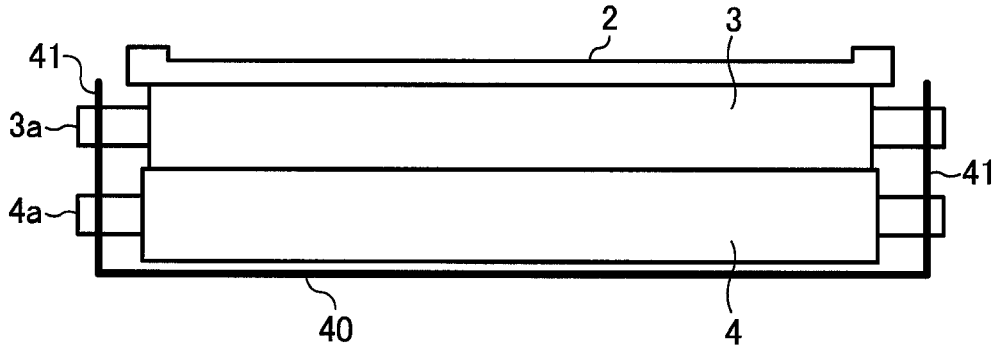
FIG. 3 is another schematic cross-sectional view of a fixing unit of FIG. 2.

As shown in FIG. 3, when the supporting frame 40 is cut in a direction along the shaft 3*a* of the fixing roller 3, the supporting frame 40 may have a semi-rectangular like shape as cross-sectional shape, for example.

As shown in FIG. 3, the supporting frame 40 may include a shaft supporter 41 at both end of the supporting frame 40, at which the end portion of the shafts 3*a* and 4*a* of the fixing roller 3 and pressure roller 4 may be supported.

As shown in FIG. 3, the shaft supporter 41 may be positioned at an outer side of an end portion of the external coil 2 used as magnetic flux generator.

The metal material used for forming the supporting frame 40 may include SUS (stainless steel) having magnetic property, carbon steel, or the like.

Figure 4:
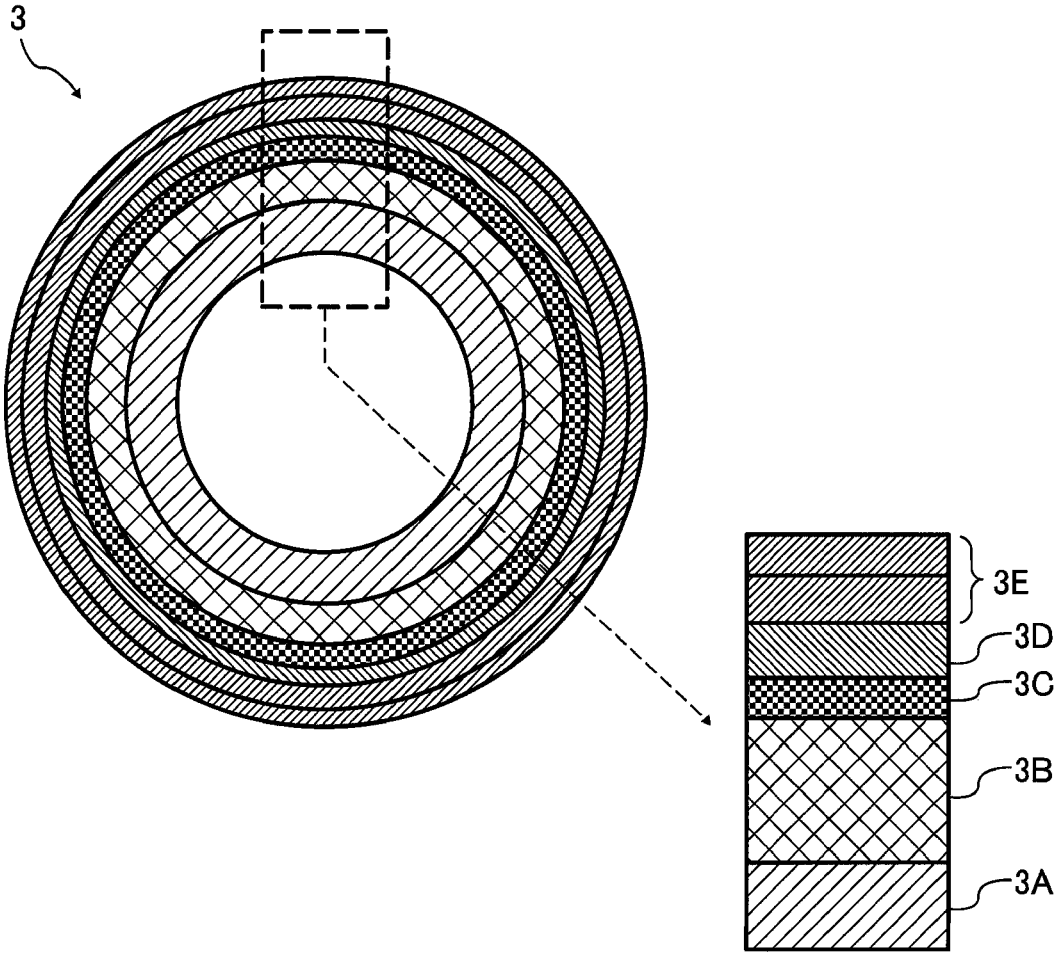
FIG. 4 is a schematic cross-sectional view (according to an example embodiment of the present invention) of a heating roller of a fixing unit of FIG. 2.

FIG. 4 illustrates a schematic cross-sectional view of the fixing roller 3, and a partially expanded view of the fixing roller 3. The fixing roller 3 may include a core metal 3A, a heat-insulating layer 3B, a magnetism regulating layer 3C, a heat generating layer 3D, and a surface layer 3E, for example, as shown in FIG. 3.

The heat-insulating layer 3B may be made of an elastic material, for example.

The magnetism regulating layer 3C and the heat generating layer 3D may be provided as different layers, for example.

The core metal 3A may be made of metal material such as aluminum or aluminum alloy, for example.

The surface layer 3E may be made of a resinous material such as silicone rubber and PFA (perfluoroalkoxy), for example.

The magnetism regulating layer 3C and heat generating layer 3D may be formed as integrated layer with a method of coating, vapor depositing, and cladding, or the like, for example.

The magnetism regulating layer 3C and heat generating layer 3D may be used as heat generating layer, which may generate heat with an effect of magnetic flux.

As shown in FIG. 2, the fixing roller 3 may form a fixing nip with the pressure roller 4, at which the fixing roller 3 may be deformed with a pressure effect of the pressure roller 4. The fixing roller 3 and the pressure roller 4 may fix an image on the recording medium S when the recording medium S passes through the fixing nip.

Figure 5:
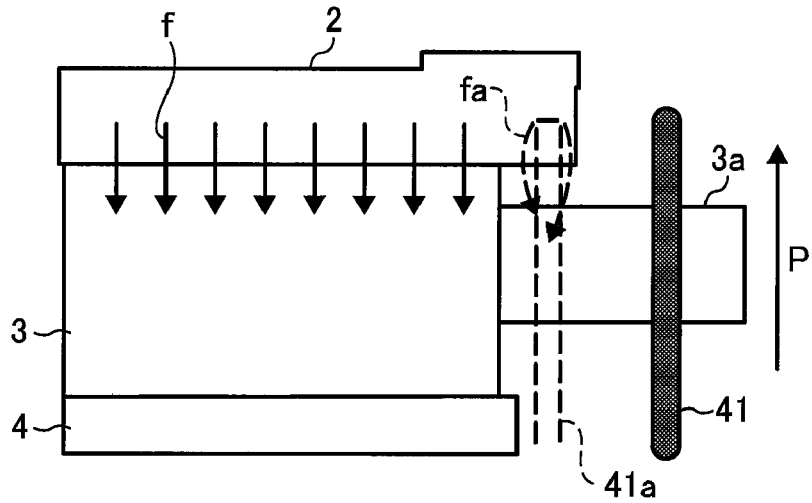
FIG. 5 is a schematic partially-enlarged view of a fixing unit of FIG. 3.

FIG. 5 shows a positioning of the shaft supporter 41 of the supporting frame 40 with respect to the end portion of the external coil 2 in a direction of the shaft 3*a* of the fixing roller 3.

When a shaft supporter 41*a* (illustrated with a dotted line in FIG. 5) is positioned at an inner side of the end portion of the external coil 2, i.e., is positioned substantially in a magnetic flux fa, the magnetic flux fa (dotted line in FIG. 5) may affect to the shaft supporter 41*a* as shown in FIG. 5.

On one hand, in an example embodiment, the shaft supporter 41 may be positioned at an outer side of the end portion of the external coil 2 as shown in FIG. 5, i.e., is positioned substantially out of the magnetic flux f and/or fa. Accordingly, a magnetic flux f generated by the external coil 2 may not reach the shaft supporter 41, by which a magnetic flux may not affect the shaft supporter 41.

With such configuration, an effect of the magnetic flux f to the shaft supporter 41 of supporting frame 40 may become relatively smaller, by which heat may not be generated on the shaft supporter 41. Accordingly, a heat generating efficiency of the heat generating layer 3D of the fixing roller 3 may be enhanced.

Because the shaft supporter 41 placed at a given position shown in FIG. 5 may less likely receive an effect of the magnetic flux f and may less likely generate heat as above explained, a position of the fixing roller 3 supported by the supporting frame 40 shown in FIG. 5 can be changed in a direction shown by an arrow P. Accordingly, the fixing roller 3 may be positioned closer to the external coil 2, and thereby a heat generating efficiency of the heat generating layer 3D of the fixing roller 3 may be further enhanced.

As such, a magnetic flux generated by the external coil 2 may less likely affect to the supporting frame 40 in an example embodiment.

An intensity of magnetic field varies inversely with the square of the distance. Accordingly, it may be desirable to set a longer distance between the external coil 2 and supporting frame 40 compared to a distance of the external coil 2 and fixing roller 3 to suppress an effect of magnetic flux to the supporting frame 40.

In this disclosure, a heatable rotating member may include a fixing roller, a fixing sleeve, and a fixing belt, for example.

Figure 6:
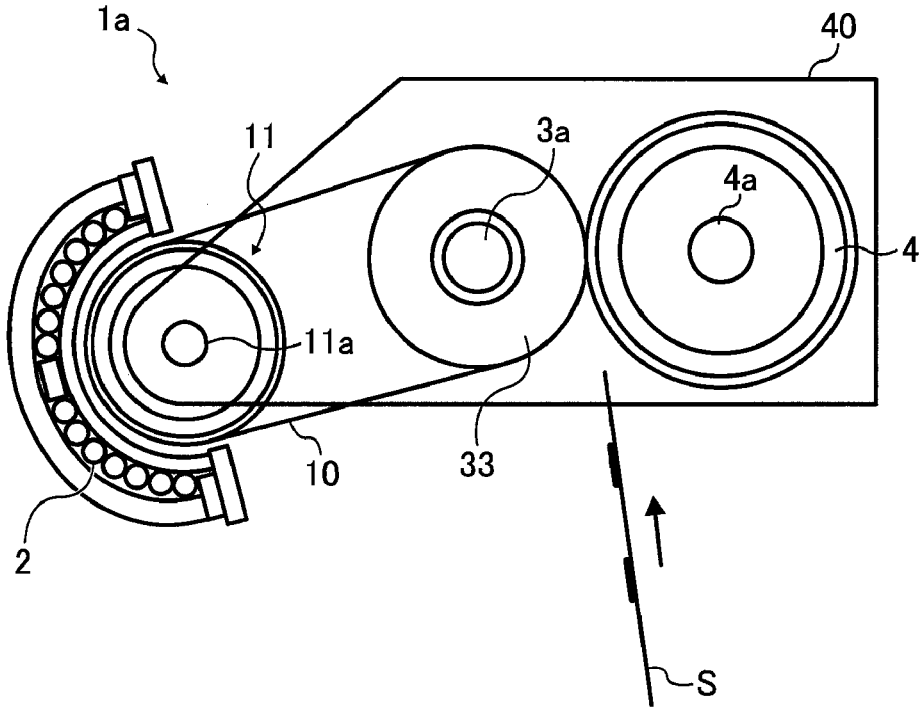
FIG. 6 is a schematic cross-sectional view of another fixing unit according to an example embodiment of the present invention.

FIG. 6 is a schematic cross-sectional view of another fixing unit 1*a* according to an example embodiment. The fixing unit 1*a* may include a fixing belt 10, an external coil 2, a first roller 33, and a second roller 11, for example.

In such configuration, the fixing belt 10 may be used as heatable rotating member by providing a heat generating layer therein, and may be extended by the first roller 33 and second roller 11, which may be used as a tension roller.

The external coil 2 may generate a magnetic flux so that the fixing belt 10, used as heatable rotating member, can generate heat with an effect of such magnetic flux.

As shown in FIG. 6, the first roller 33, the pressure roller 4, and the fixing belt 10 may form a fixing nip, at which an image may be fixed on a recording medium S by applying pressure to the recording medium S with the fixing belt 10, first roller 33, and pressure roller 4.

In a configuration shown in FIG. 6, the supporting frame 40 may support the shaft 3*a* of first roller 33, the shaft 11*a* of second roller 11, and the shaft 4*a* of pressure roller 4, for example.

Instead of such supporting configuration, although not shown, the supporting frame 40 may be configured to support at least the second roller 11, and other supporting members may be provided to support the first roller 3 and pressure roller 4, for example.

Further, in a configuration shown in FIG. 6, the second roller 11 may be used as heatable rotating member instead of the fixing belt 10 by providing a heat generating layer in the second roller 11. In such a case, the second roller 11 may generate heat with an effect of magnetic flux of the external coil 2, and such generated heat may be used to heat the fixing belt 10. The second roller 11 may heat the fixing belt 10 when the fixing belt 10 travels on or around the second roller 11. Such second roller 11 may also be used as tension roller to extend the fixing belt 10.

Accordingly, in a configuration shown in FIG. 6, any one of the fixing belt 10 and second roller 11 may be used as heatable rotating member, and the second roller 11 may also be used as tension roller to extend the fixing belt 10.

Figure 7:
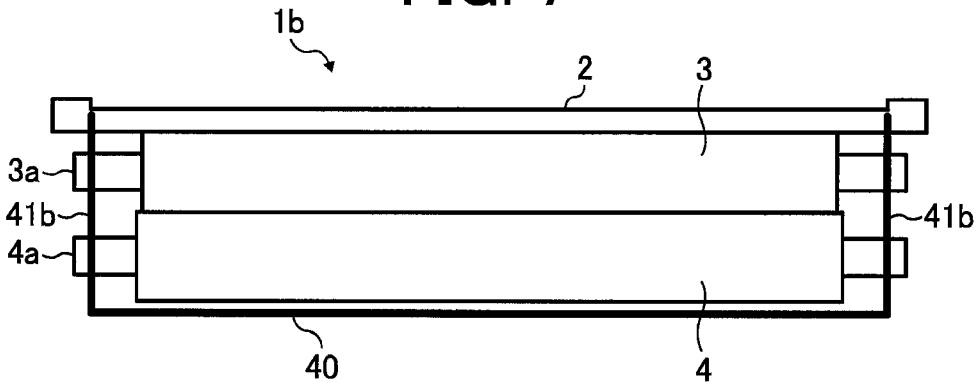
FIG. 7 is a schematic cross-sectional view of another fixing unit of FIG. 6 according to an example embodiment of the present invention.
Figure 8A:
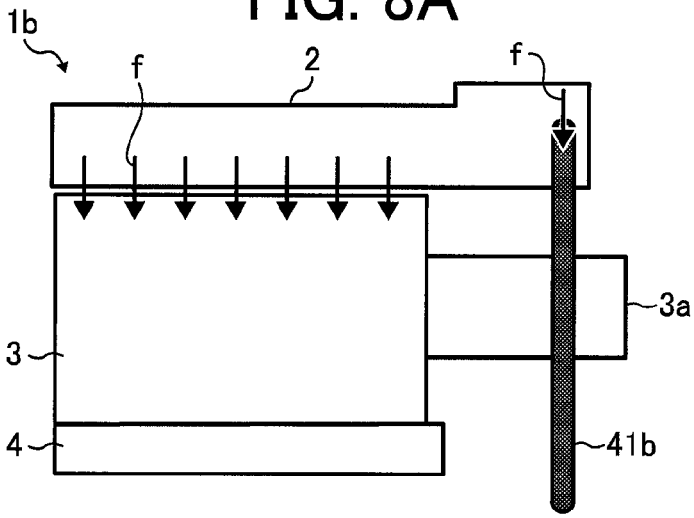
FIGS. 8A and 8B are schematic partially-enlarged views (according to an example embodiment of the present invention) of a fixing unit of FIG. 7.
Figure 8B:
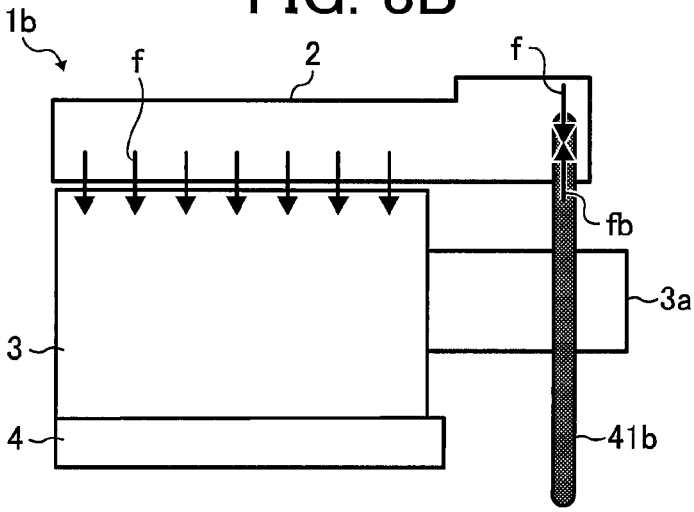

FIG. 7 shows another fixing unit 1*b* according to an example embodiment, and FIGS. 8A and 8B show schematic cross-sectional views of the fixing unit 1*b*.

In the fixing unit 1*b*, the supporting frame 40 as a whole or at least the shaft supporter 41 may be configured with a non-magnetic material to suppress an effect of magnetic flux of the external coil 2.

The fixing unit 1*b* shown in FIG. 7 may have a configuration similar to the fixing unit 1 shown in FIG. 3.

In the fixing unit 1*b* shown in FIG. 7, the supporting frame 40 has a shaft supporter 41*b*, which may support the external coil 2 in addition to the fixing roller 3 and pressure roller 4. Specifically, the shaft supporter 41*b* may support a casing of the external coil 2, for example.

The supporting frame 40 and shaft supporter 41*b* may be configured with a material having non-magnetic property such as resin, aluminum, copper, and SUS (stainless steel) having non-magnetic property, for example.

FIG. 8A shows a case that the shaft supporter 41*b* is made of resin material. As shown in FIG. 8A, magnetic flux f may be generated in a portion that the external coil 2 faces the fixing roller 3.

Because the shaft supporter 41*b* is made of a resin material, an eddy current may not be generated on the shaft supporter 41*b* although the magnetic flux f may exist around the shaft supporter 41*b*. Therefore, even if the magnetic flux f may reach to the shaft supporter 41*b*, the shaft supporter 41*b* or the supporting frame 40 made of non-magnetic material may not generate heat with an effect of the magnetic flux f.

FIG. 8B shows a case that the shaft supporter 41*b* is made of a conductive material having non-magnetic property such as aluminum, copper, and SUS (stainless steel) having non-magnetic property. In such a case, magnetic flux fb generated on the shaft supporter 41*b*, made of conductive material, may cancel an effect of the magnetic flux f generated by the external coil 2. Accordingly, even if the magnetic flux f may reach to the shaft supporter 41*c*, the shaft supporter 41*b* or the supporting frame 40 may not generate heat with an effect of the magnetic flux f.

Although not shown, the configuration shown in FIGS. 7 and 8 can be employed for the fixing unit 1*b*, having a belt configuration, shown in FIG. 6.

Figure 9:
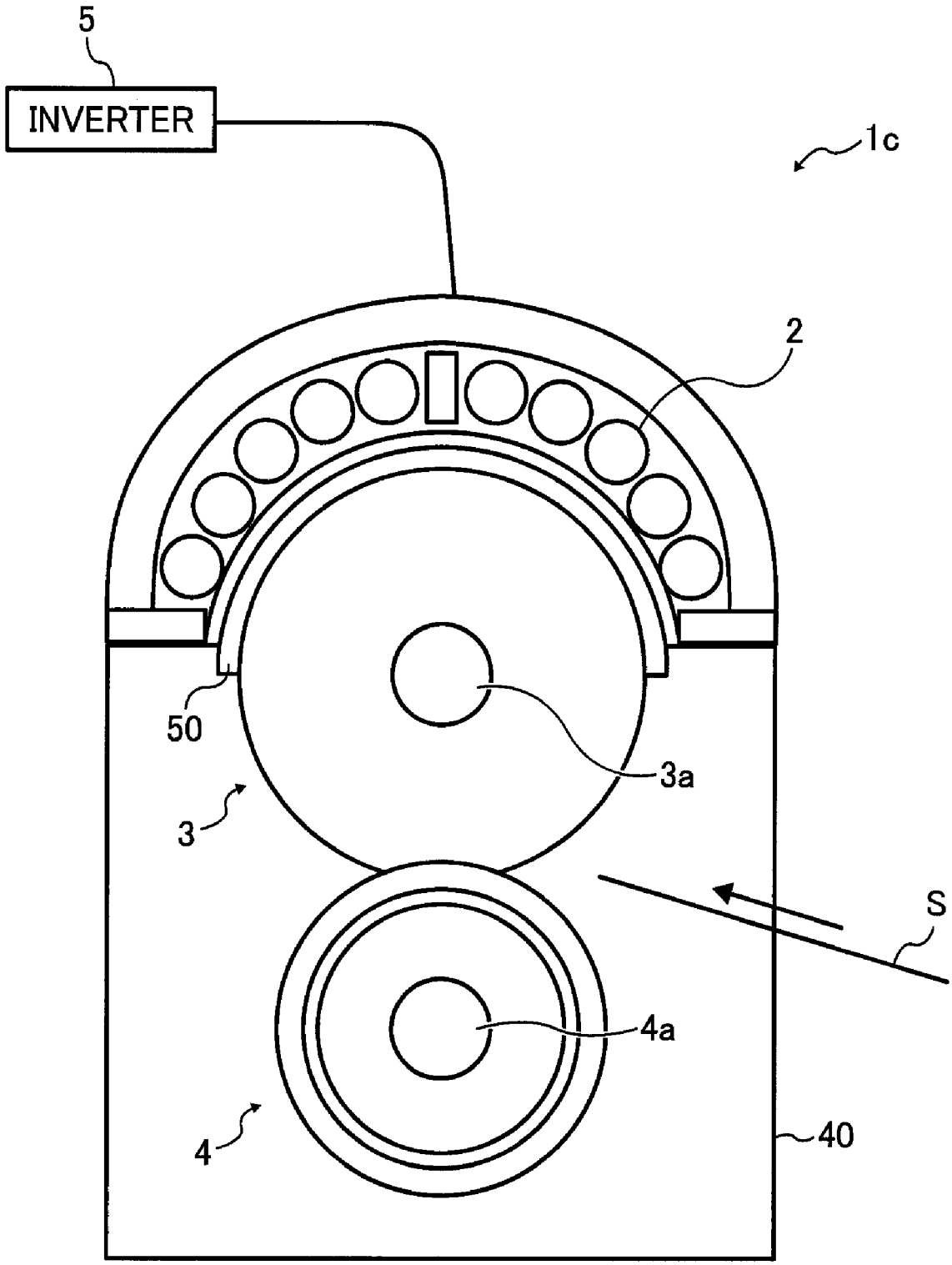
FIG. 9 is a schematic cross-sectional view of another fixing unit according to an example embodiment of the present invention.
Figure 10:
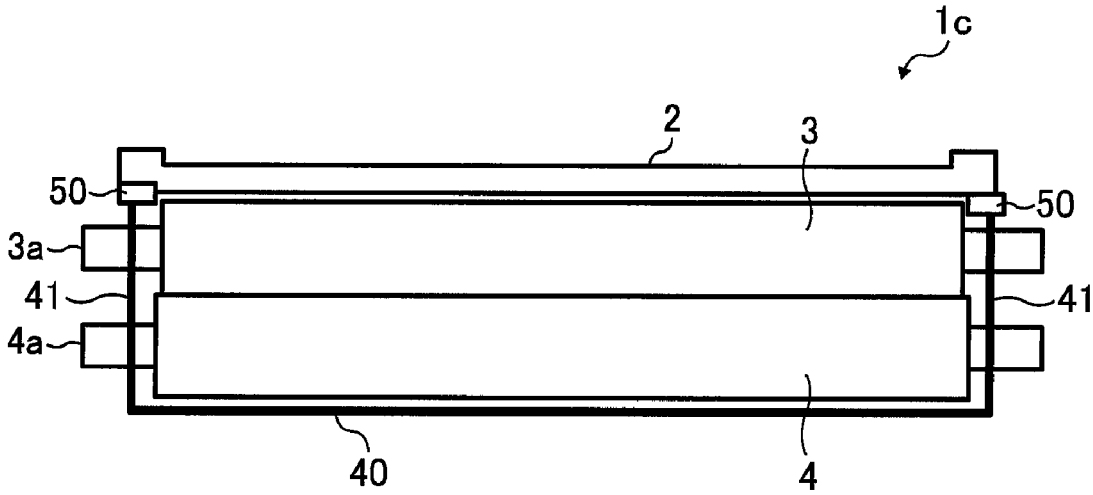
FIG. 10 is another schematic cross-sectional view (according to an example embodiment of the present invention) of a fixing unit of FIG. 9.
Figure 11:
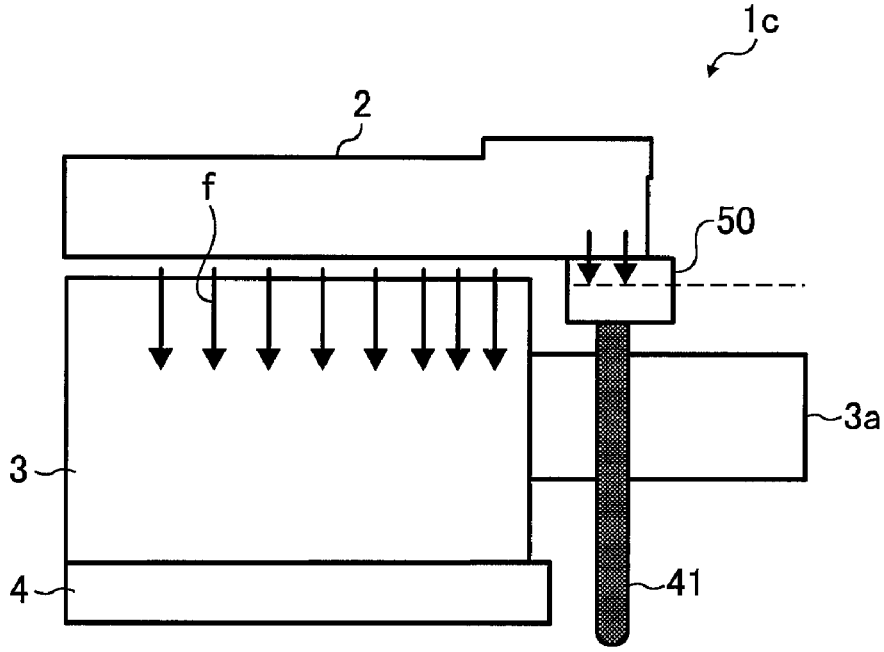
FIG. 11 is a schematic partially-enlarged view of a fixing unit of FIG. 10.

FIGS. 9 and 10 show schematic cross-sectional views of another fixing unit 1*c* according to an example embodiment. FIG. 11 is a schematic enlarged view of the fixing unit 1*c* shown in FIG. 10.

The fixing unit 1*c* shown in FIGS. 9, 10, and 11 may have a configuration similar to the fixing unit 1 shown in FIGS. 2 to 5.

The fixing unit 1*c* may have the shaft supporter 41, which may be positioned at an inner side of the end portion of the external coil 2 as shown in FIGS. 10 and 11.

As shown in FIGS. 10 and 11, the fixing unit 1*c* may further include a shielding member 50 between the external coil 2 and the shaft supporter 41*c* to shield the shaft supporter 41 from the magnetic flux f generated by the external coil 2. The shielding member 50 may have a curved-shape as shown in FIG. 9, for example.

The shielding member 50 may be made of a conductive material having a relatively lower electric resistance such as aluminum, and copper, or a magnetic material such as ferrite, for example.

The shielding member 50 may contact the shaft supporter 41*c* and external coil 2 to regulate (or adjust) a gap between the supporter 41*c* and external coil 2.

The shielding member 50 may need to have a given thickness to shield a magnetic flux generated by the external coil 2. Such given thickness may be determined based on an intensity of magnetic flux and other factors.

If the shielding member 50 may have at least such given thickness, the magnetic flux f of the external coil 2 may be effectively shielded even if the supporting frame 40 or shaft supporter 41 may be made of metal material as shown in FIG. 11.

Specifically, as shown in FIG. 11, the magnetic flux f generated by the external coil 2 may be substantially shielded by the shielding member 50, by which the magnetic flux f may less likely reach to the shaft supporter 41. Accordingly, the supporting frame 40 may be less likely heated with an effect of the magnetic flux f.

The shielding member 50 may shield the supporting frame 40 or shaft supporter 41 from a magnetic flux, but should not shield a heat generating layer of the fixing roller 3 from a magnetic flux.

Such shielding condition may become possible by positioning the shielding member 50 outside of a sheet transport space (not shown) in a fixing unit. The sheet transport space may mean a space around a fixing nip formed by the fixing roller 3 and pressure roller 4. For example, the shielding member 50 shown in FIG. 10 may not shield a magnetic flux to be forwarded to a heat generating layer of the fixing roller 3.

Figure 12A:
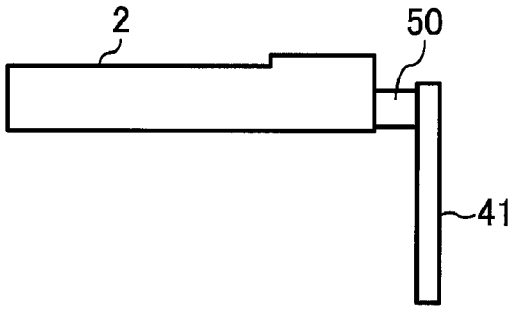
FIGS. 12A and 12B are schematic cross-sectional views (according to an example embodiment of the present invention) for a positioning of a shielding member in a fixing unit of FIG. 10.
Figure 12B:
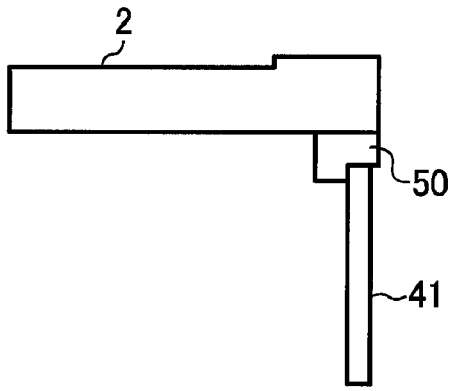

Further, a positional relationship of the shielding member 50 and shaft supporter 41 may be changed as shown in FIG. 12, as required.

Further, the shielding member 50 may also be used as a reinforcement member of the supporting frame 40, for example. Further, if the shielding member 50 may be used as gap regulating (or adjusting) member, the shielding member 50 may be attached to a casing of the external coil 20 instead of the supporting frame 40, for example. However, if the shielding member 50 may be attached to the supporting frame 40, the shielding member 50 may be used as non-replacement part, by which a cost reduction may be achieved.

Further, because the shaft supporter 41 can be positioned at the inner side of the external coil 2 as shown in FIGS. 10 and 11, the fixing unit 1*c* can reduce its dimension in a direction of the shaft 3*a* of the fixing roller 3, which may be preferable for miniaturization of the fixing unit 1*c*.

Figure 13:
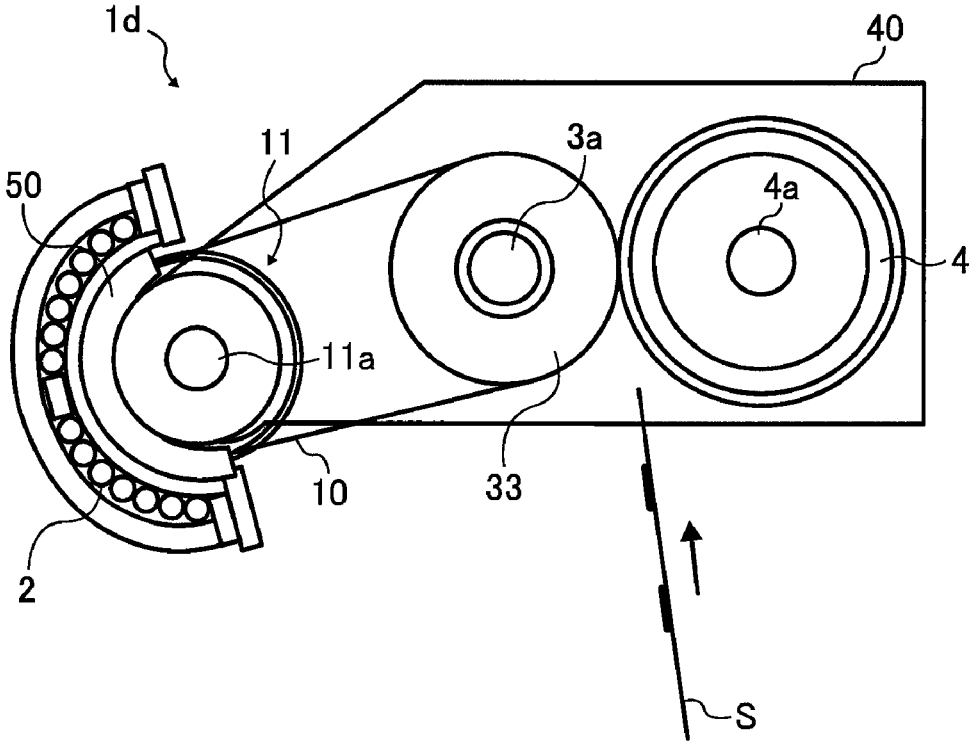
FIG. 13 is a schematic cross-sectional view of another fixing unit according to an example embodiment of the present invention.

FIG. 13 shows another fixing unit 1*d* according to an example embodiment. The fixing unit 1*d* may include a shielding member 50 as similar to the fixing unit 1*c* shown in FIG. 10, and the fixing belt 10 as heatable rotating member, for example.

The fixing unit 1*d* may have a configuration substantially similar to the fixing unit 1*a* shown in FIG. 6 except that the fixing unit 1*d* may have the shielding member 50 between the external coil 2 and second roller 11. The shielding member 50 may have a curved-shape, for example. An effect of the shielding member 50 in the fixing unit 1*d* may be similar to the effect of the shielding member 50 in the fixing unit 1*c*.

Figure 14A:
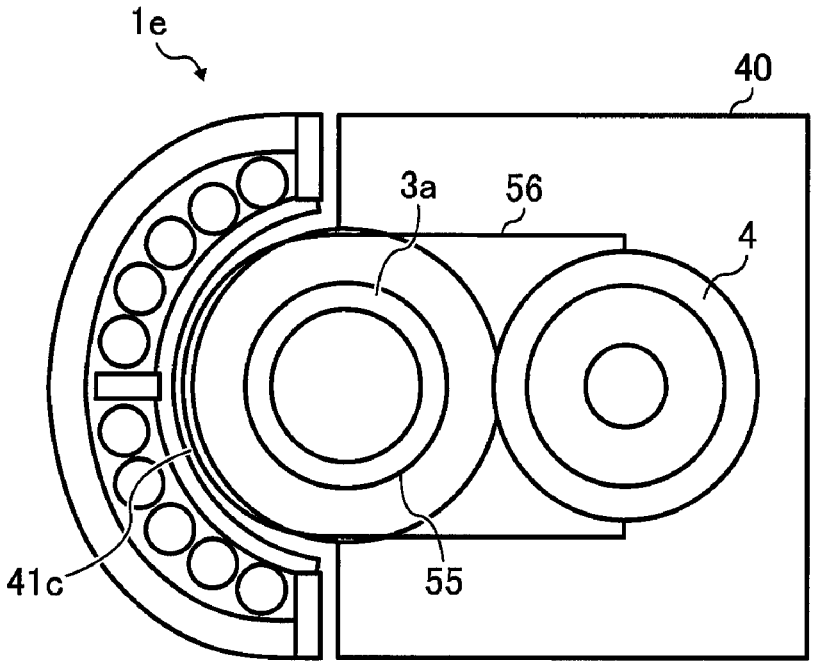
FIGS. 14A and 14B are schematic cross-sectional views of another fixing unit according to an example embodiment of the present invention.
Figure 15:
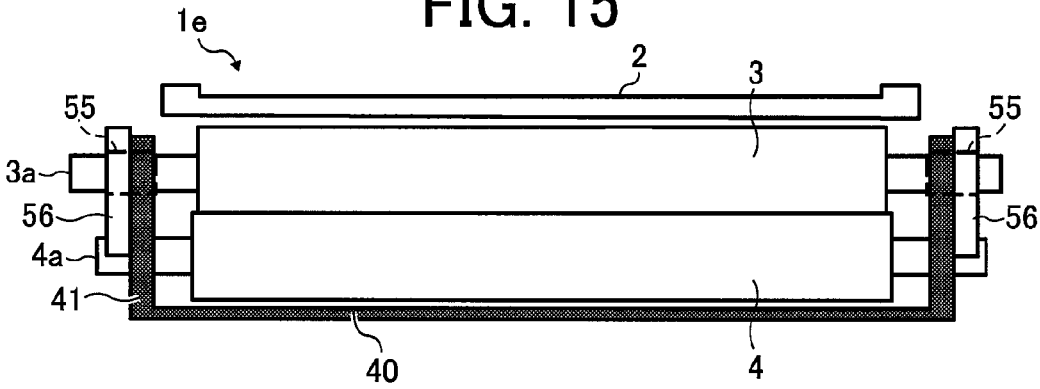
FIG. 15 is a schematic cross-sectional view of a fixing unit of FIG. 14A.
Figure 16:
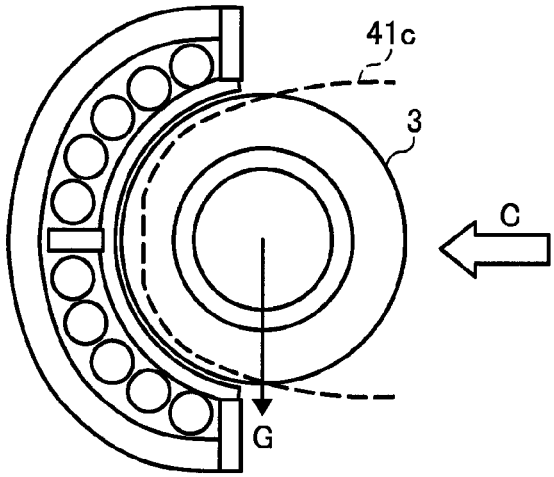
FIG. 16 is a schematic enlarged view (according to an example embodiment of the present invention) of a fixing unit of FIG. 15.

FIGS. 14A and 15 are schematic cross-sectional views of another fixing unit 1*e* according to an example embodiment. FIG. 16 is a partially enlarged view of the fixing unit 1*e* of FIG. 15.

As described later, the supporting frame 40 shown in FIGS. 14A and 15 may have a shape, which may substantially matches a perimeter shape of the external coil 2.

The fixing unit 1*e* may have a configuration similar to the fixing unit 1 shown in FIGS. 2, 3, and 5. The fixing unit 1*e* may have a different configuration compared to the fixing unit 1 as below.

For example, in the fixing unit 1*e*, the fixing roller 3 and the pressure roller 4 may receive a load from a different direction compared to the fixing unit 1 shown in FIG. 2. As shown in FIG. 16, the fixing roller 3 may receive a gravitation force G.

Figure 14B:
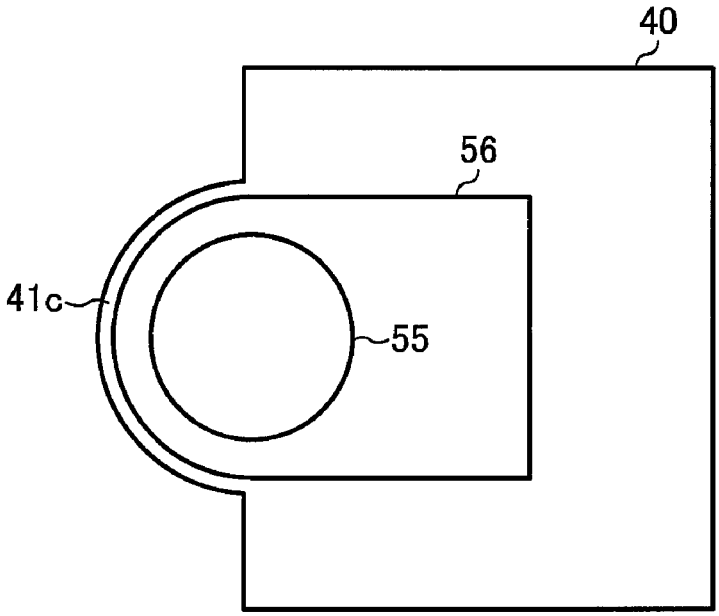
Figure 14C:
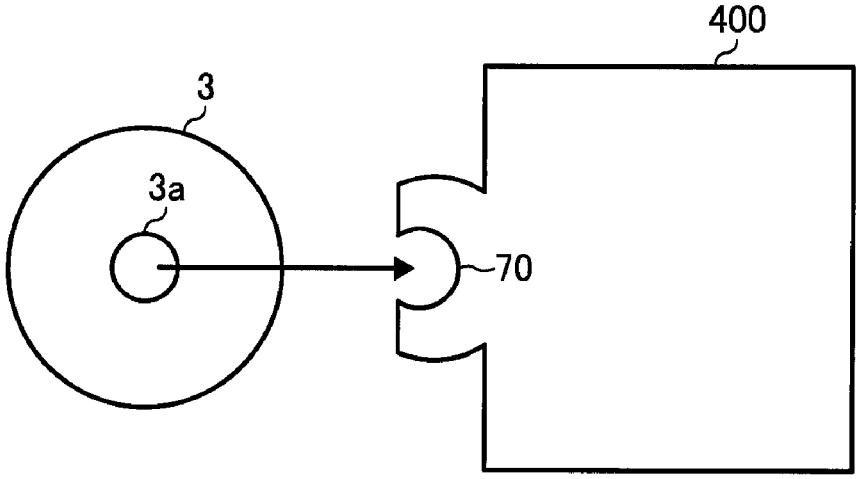
FIGS. 14C and 14D are schematic cross-sectional views (according to an example embodiment of the present invention) of a fixing roller and a notch-provided plate for supporting a fixing roller.
Figure 14D:
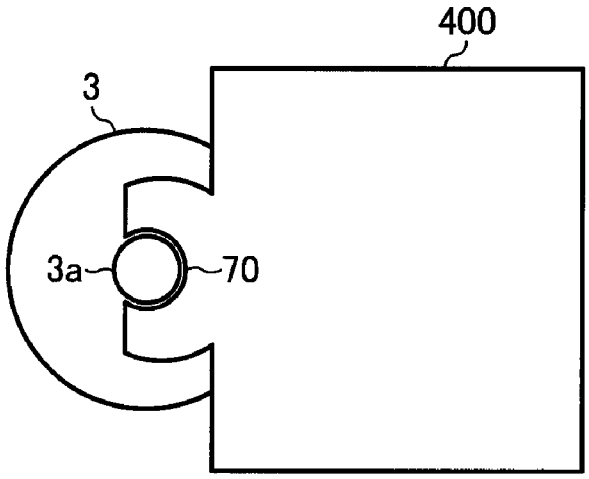

In the previously explained fixing units shown in FIGS. 2 and 9, a notch 70 shown in FIGS. 14C and 14D may be provided to a shaft supporter 400 to support the shaft 3*a* of fixing roller 3 when the fixing roller 3 is assembled to the shaft supporter 400.

Generally, the configuration shown in FIGS. 14C and 14D may be applied to a fixing unit having a fixing roller of relatively light weight because such notch-provided shaft supporter 400 may not effectively support a fixing roller having relatively heavier weight because such notch-provided portion may have a relatively lower strength to support a heavier object (e.g., fixing roller).

Although the fixing units shown in FIGS. 2 and 9 may include the fixing roller 3 having relatively heavier weight, the configuration shown in FIGS. 14C and 14D can be applied to the fixing units 1 and 1*c* because the pressure roller 4 may also be used to support the weight of the fixing roller 3.

On one hand, if such notch-provided configuration is employed for the fixing unit 1*e* shown in FIG. 14A, the supporting frame 40 may not have a strength to withstand a weight of the fixing roller 3 having relatively heavier weight, by which the supporting frame 40 may be undesirably deformed. Such deformation of the supporting frame 40 may cause a rotational eccentricity of the fixing roller 3.

Such rotational eccentricity of the fixing roller 3 may affect a gap distance between the fixing roller 3 and the external coil 2 along a direction of the shaft 3*a* of the fixing roller 3. Specifically, such rotational eccentricity may cause a variation of gap distance between the fixing roller 3 and the external coil 2 along a direction of the shaft 3*a*, by which the fixing roller 3 may not generate heat uniformly thereon, which is not preferable for a fixing process.

As shown FIG. 14A, the fixing unit 1*e* may be placed in the image forming apparatus 20 in a horizontal direction. If the fixing unit 1*e* may be placed in a horizontal direction, the fixing roller 3 having relatively heavier weight may not be supported by the pressure roller 4, but may be supported by the supporting frame 40.

Accordingly, a thickness of the shaft supporter 41 of the supporting frame 40 may be increased to effectively support the fixing roller 3 having relatively heavier weight.

Further, instead of the notch-provided shaft supporter, the shaft supporter 41 may be provided with a support hole 55 to effectively support the shaft 3*a* of the fixing roller 3. The support hole 55 may be integrally formed in the shaft supporter 41. In other words, a portion around the support hole 55 may have a relatively higher strength compared to the above-mentioned notch-provided portion.

Further, a reinforcement member 56 to support a weight of the fixing roller 3 may be provided around the support hole 55 to further reduce (if not prevent) a deformation of the shaft supporter 41 and supporting frame 40 as shown in FIGS. 14A and 14B.

If the reinforcement member 56 may be provided as shown in FIGS. 14A and 15, strength of the supporting frame 40 may be enhanced, by which a deformation of the supporting frame 40 may be suppressed.

Further, compared to the notch-provided configuration, the supporting frame 40 having the reinforcement member 56 may be less likely deform, by which a thickness of the supporting frame 40 (specifically, shaft supporter 41) may be formed thinner. Accordingly, a reduction of manufacturing cost of fixing unit may be achieved.

The reinforcement member 56 may be made of a material such as resin, aluminum, copper, SUS (stainless steel), etc., having non-magnetic property, wherein such material may less likely generate heat.

Further, as shown in FIGS. 14A and 14B, the shaft supporter 41 may have a curve-shaped portion 41*c* around the support hole 55.

Such curve-shaped portion 41*c* of the shaft supporter 41 may be referred as "projecting portion 41*c*" because such portion may look like projecting toward the external coil 2.

With such projecting portion 41*c*, the fixing roller 3 may be set closer to the external coil 2, by which a heat generating efficiency of heat generating layer of the fixing roller 3 may be enhanced.

On one hand, non-projecting portion of the shaft supporter 41 may be distanced from the external coil 2. Accordingly, such non-projecting portion may be less likely affected by a magnetic flux generated by the external coil 2.

The reinforcement member 56 may have a given shape, which can effectively reinforce an area around the support hole 55 to be fitted with the shaft 3*a* of the fixing roller 3.

As shown in FIG. 16, the projecting portion 41*c* may be formed into a curved-shape, which may substantially match a perimeter shape of the fixing roller 3.

With such projecting portion 41*c*, the supporting frame 40 can be moved toward a direction shown by an arrow C (see FIG. 16) to set a gap between the fixing roller 3 and external coil 2 to a smaller value, by which a heat generating efficiency of heat generating layer of the fixing roller 3 may be enhanced.

With such projecting portion 41*c*, a stress caused by a weight of fixing roller 3 may be evenly received by the projecting portion 41*c* of the shaft supporter 41 and reinforcement member 56, by which the supporting frame 40 may not be easily deformed.

Figure 17:
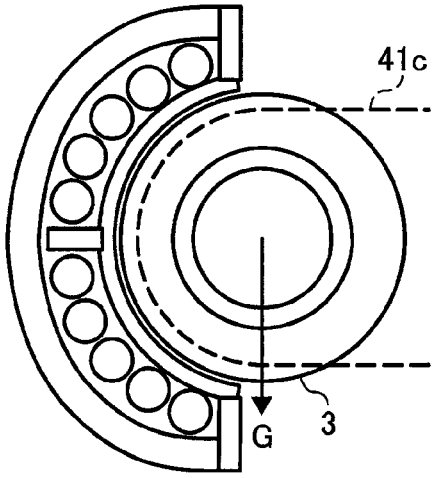
FIG. 17 is another schematic cross-sectional view (according to an example embodiment of the present invention) of a fixing unit of FIG. 15.

Further, as shown in FIG. 17, the projecting portion 41*c* may be formed into a curved-shape, which may substantially match a perimeter shape of the external coil 2 used as magnetic flux generator.

With such projecting portion 41*c*, a gap between the fixing roller 3 and external coil 2 may be set smaller, by which a heat generating efficiency of heat generating layer of the fixing roller 3 may be enhanced.

Figure 18:
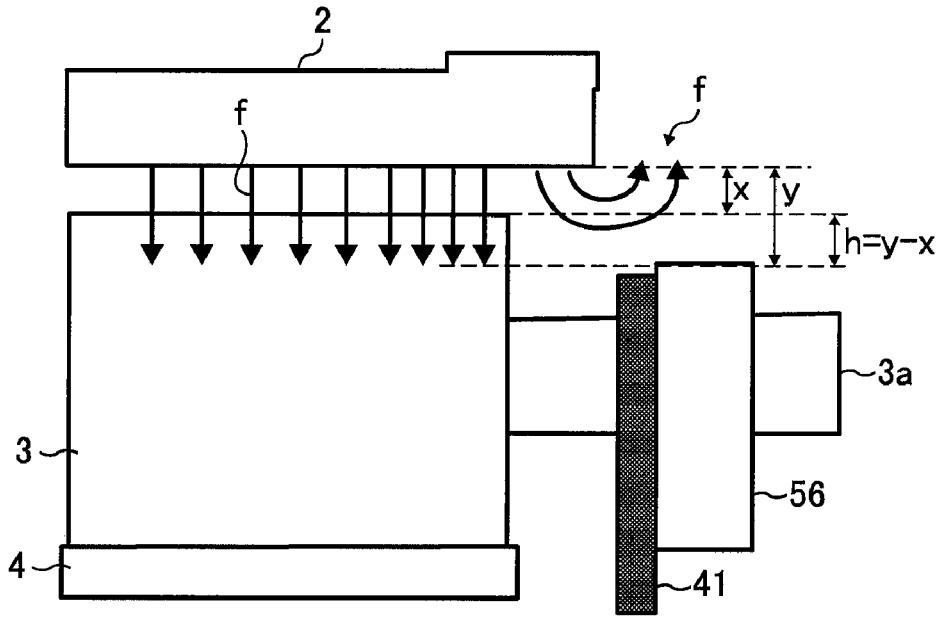
FIG. 18 is another schematic partially-enlarged view of fixing unit of FIG. 14A.

Further, the supporting frame 40 and the fixing roller 3 may have a positional relationship as shown in FIG. 18.

In such configuration, an end portion of the supporting frame 40 most close to the external coil 2 may have a distance "y," which may be greater than a distance "x" of a surface of the fixing roller 3 most close to the external coil 2. Such distance difference "h" may be expressed as "h=y−x" as shown in FIG. 18.

In such configuration, the magnetic flux f may less likely reach the shaft supporter 41 of the supporting frame 40. Accordingly, the supporting frame 40 may less likely generate heat, and a heat generating efficiency of the heat generating layer of the fixing roller 3 may be enhanced.

Although not shown, the fixing unit 1*a* using belt configuration shown in FIG. 6 can employ the configurations shown in FIGS. 14 to 18.

Figure 19:
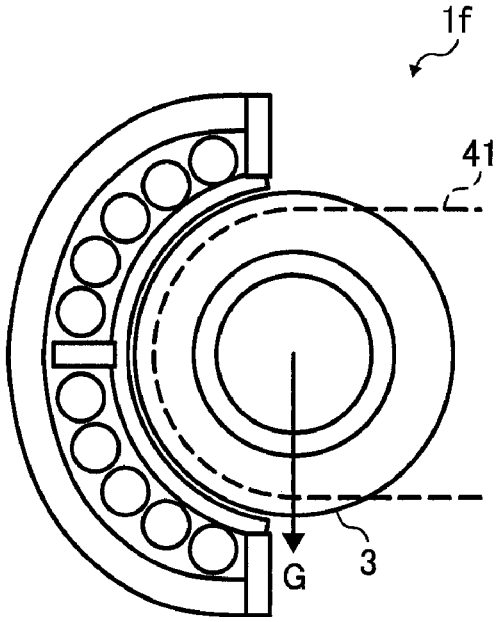
FIG. 19 is a schematic cross-sectional view of another fixing unit according to an example embodiment of the present invention.

FIG. 19 is a schematic cross-sectional view of another fixing unit 1*f* according to an example embodiment.

In the fixing unit 1*f* shown in FIG. 19, the supporting frame 40 may have the projecting portion 41*c* formed in rounded shape (R-shape), by which a magnetic flux concentration at an end portion of the supporting frame 40 may be suppressed. Such R-shape configuration may be employed in the fixing units according to an example embodiment.

For example, such projecting portion 41*c* formed in R-shape may have a half-moon shape as shown in FIG. 19, by which a magnetic flux concentration at an end portion of shaft supporter 41 may be suppressed.

Figure 20A:
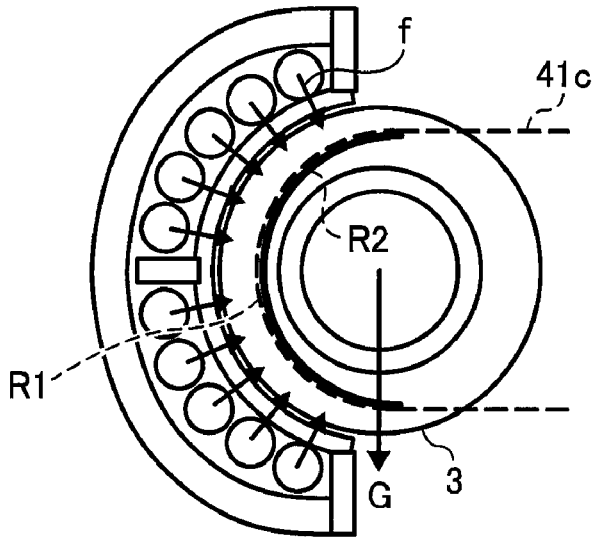
FIGS. 20A and 20B are schematic cross-sectional views (according to an example embodiment of the present invention) of a fixing unit for explaining an effect of magnetic flux to a fixing unit.
Figure 20B:
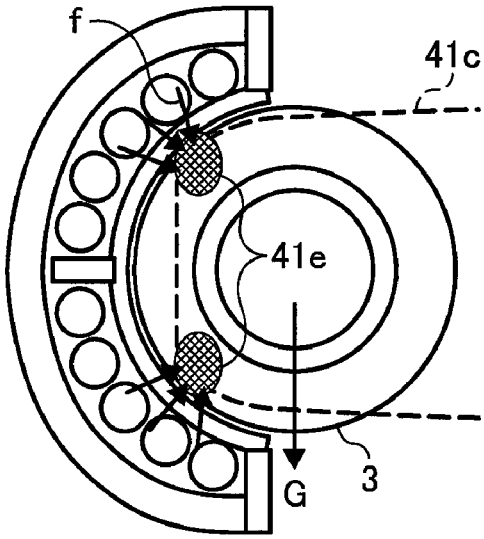

If the projecting portion 41*c* of the shaft supporter 41 may have an edge 41*a* as shown in FIG. 20B, the magnetic flux f generated by the external coil 2 may concentrate on the edge 41*a*. Such concentrated magnetic flux f may cause an abnormal heating on the edge 41*e*.

If the projecting portion 41*c* of the shaft supporter 41 may have a shape having no sharp edges as shown in FIG. 20A such as semicircular shape R1 or elliptical shape R2, for example, a concentration of magnetic flux f may not occur at the projecting portion 41*c* of the shaft supporter 41. Accordingly, the projecting portion 41*c* of the shaft supporter 41 may not be heated locally, by which an overheating at an end portion of the shaft supporter 41 may be reduced (if not prevented).

With such shaping shown in FIG. 20A, the shaft supporter 41 can be made of a material having lower heat resistance, wherein such material having lower heat resistance may be prepared with relatively lower cost. Accordingly, the shaft supporter 41 may be manufactured with a reduced cost.

Although not shown, the configuration shown in FIG. 20A may be applied to the fixing unit 1*a* using the belt configuration shown in FIG. 6.

Figure 21:
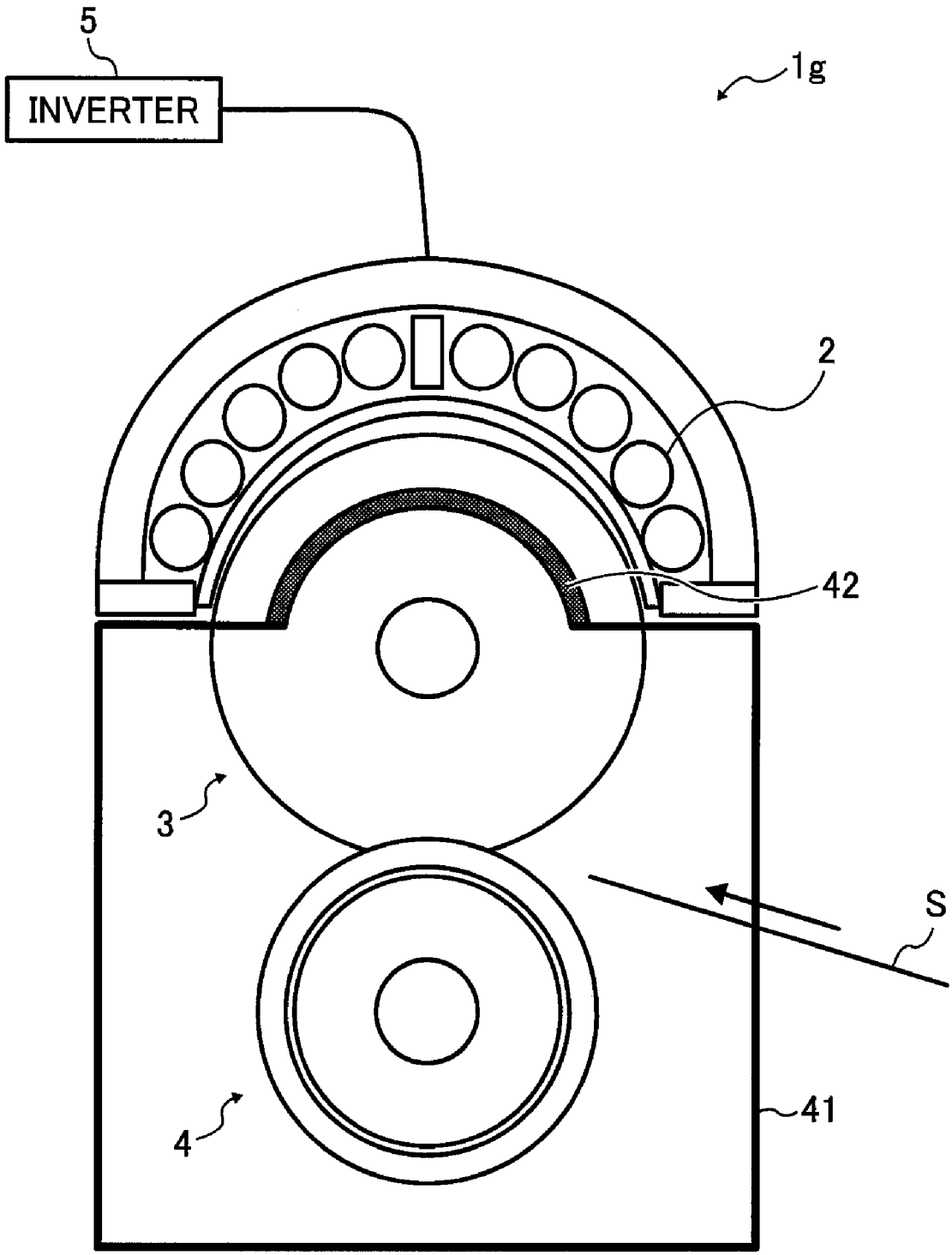
FIG. 21 is a schematic cross-sectional view of another fixing unit according to an example embodiment of the present invention.
Figure 22:
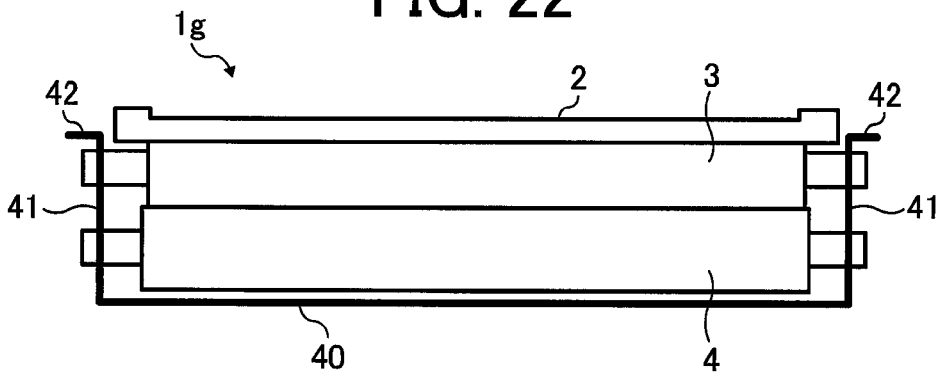
FIG. 22 is a schematic cross-sectional view (according to an example embodiment of the present invention) of a fixing unit of FIG. 21.

FIGS. 21 and 22 show schematic cross-sectional views of another fixing unit 1*g* according to an example embodiment. The fixing unit 1*g* may have a configuration similar to the fixing unit 1 shown in FIG. 2.

As shown in FIG. 22, the shaft supporter 41 of the supporting frame 40 may have an end portion close to the external coil 2, wherein such end portion may be bent as bending portion 42 in a direction of the shaft 3*a* of the fixing roller 3 and in a direction distancing from the external coil 2. Such bending portion 42 may be provided to enhance strength of the supporting frame 41.

As above-mentioned, the supporting frame 41 may deform due to a weight of the fixing roller 3, and such deformation may cause rotational eccentricity of the fixing roller 3.

By providing the bending portion 42 as above explained, strength of the supporting frame 41 as a whole may be enhanced, by which a rotational eccentricity of the fixing roller 3 may be suppressed.

Accordingly, a gap between the fixing roller 3 and external coil 2 may be maintained at a given level, by which a variation of heat generation on the fixing roller 3 may be suppressed.

Further, the magnetic flux f may have a lower intensity at an end portion of the shaft 3*a* of the fixing roller 3, by which heat generation at such end portion of the fixing roller 3 may not become so great.

In the configuration shown in FIG. 22, the bending portion 42 may be bent to an outward direction of the shaft 3*a* instead of inward direction of the shaft 3*a*. Accordingly, a magnetic flux concentration at the end portion of the supporting frame 40 may be suppressed.

Figure 23A:
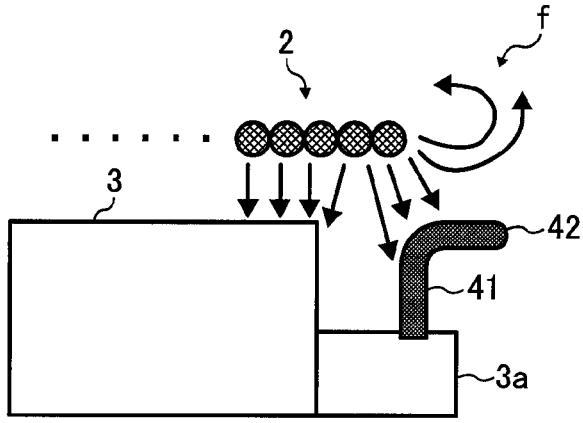
FIG. 23A shows (according to an example embodiment of the present invention) an effect of magnetic flux to a bending portion of a supporting frame of a fixing unit.

FIG. 23A shows a relationship of a shape of the bending portion 42 and magnetic flux f.

FIG. 23A shows one example shape of the bending portion 42, in which the bending portion 42 may be bent in an outward direction of the shaft 3*a* with approximately 90 degrees. Further, the bending portion 42 may be formed in R-shape to reduce magnetic flux concentration.

Figure 23B:
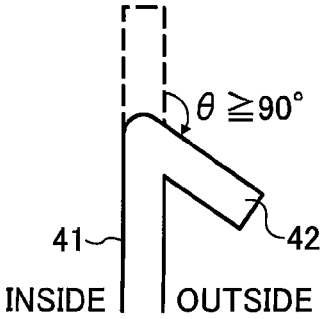
FIGS. 23B and 23C show example shapes (according to an example embodiment of the present invention) of a bending portion of a supporting frame.
Figure 23C:
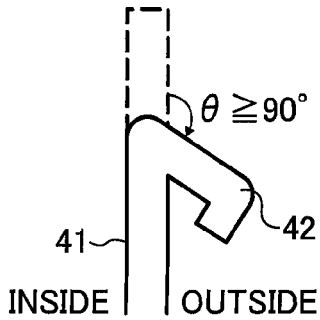

The bending portion 42 may be bent to an outward direction of the shaft 3*a* with 90 degrees or more as shown in FIG. 23B and FIG. 23C. As shown in FIG. 23C, a tip of the bending portion 42 may be further bent one more time.

Figure 24A:
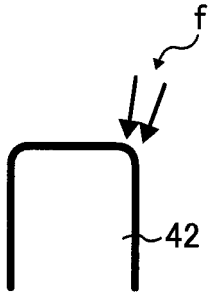
FIGS. 24A, 24B and 24C show (according to an example embodiments of the present invention) an effect of magnetic flux to a bending portion having different shapes.
Figure 24B:
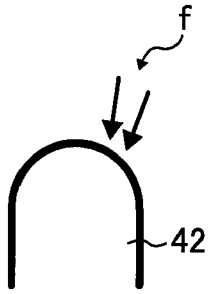

Further, as shown in FIGS. 24A and 24B, the bending portion 42 or other part of shaft supporter 41 may have a corner portion shaped in R-shape to reduce magnetic flux concentration.

Figure 24C:
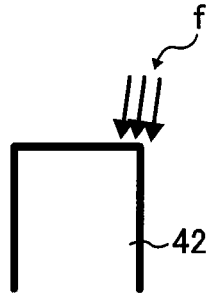

If the corner portion of the bending portion 42 may not be shaped in R-shape, a magnetic flux concentration may undesirably occur at the corner portion as shown in FIG. 24C.

Figure 25A:
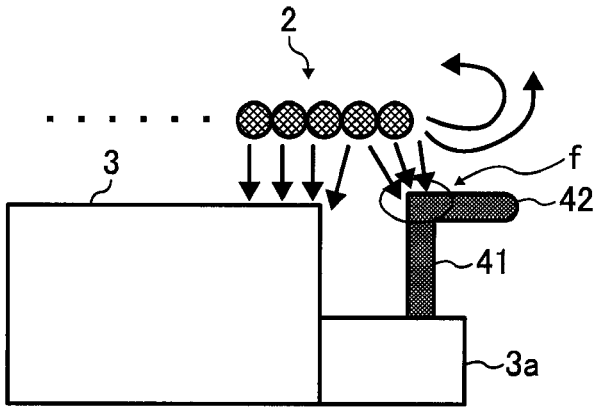
FIG. 25A shows (according to an example embodiment of the present invention) an effect of magnetic flux to another bending portion of a supporting frame of a fixing unit.
Figure 25B:
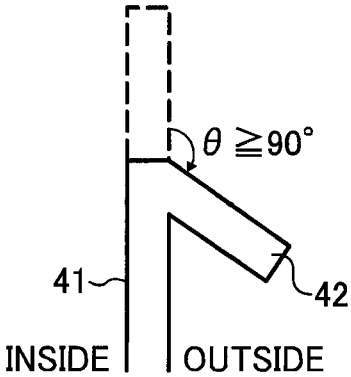
FIG. 25B shows (according to an example embodiment of the present invention) another example shape of a bending portion of a supporting frame.

Even if the bending portion 42 may be bent to an outward direction of the shaft 3*a* with 90 degrees as shown in FIG. 25A or 90 degrees or more as shown in FIG. 25B, a magnetic flux concentration may likely to occur at a corner portion having a sharper shape such as non-R shape.

In this disclosure, the R shape may mean a curved shape, which may be recognized by a human eye and used to reduce magnetic flux concentration.

Figure 26:
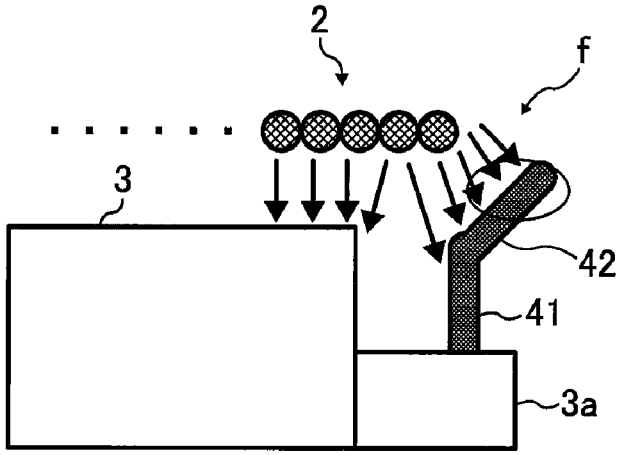
FIGS. 26 and 27 shows (according to an example embodiment of the present invention) an effect of magnetic flux to another bending portion of a supporting frame of a fixing unit.

Further, FIG. 26 shows a case that the bending portion 42 is bent in an outward direction of the shaft 3*a* with less than 90 degrees. In such a case, a gap between the bending portion 42 and external coil 2 may become smaller, by which the magnetic flux f may more likely affect the bending portion 42. Accordingly, a magnetic flux concentration may occur at the bending portion 42.

Figure 27:
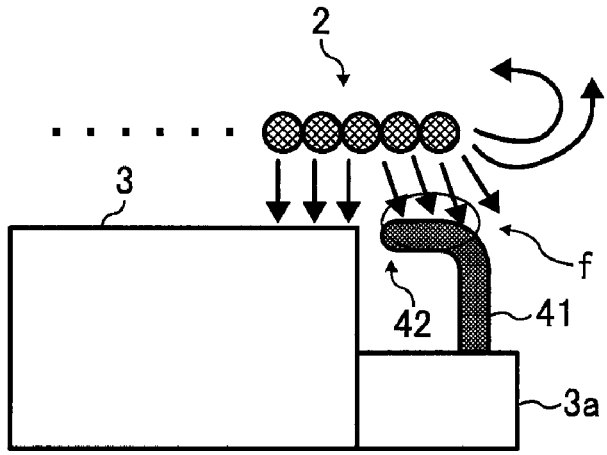

Further, FIG. 27 shows a case that the bending portion 42 is bent in an inward direction of the shaft 3*a*. In such a case, the bending portion 42 may be positioned under the external coil 2, in which the magnetic flux f may affect to the bending portion 42. Accordingly, a magnetic flux concentration may more likely occur at the bending portion 42.

Figure 28:
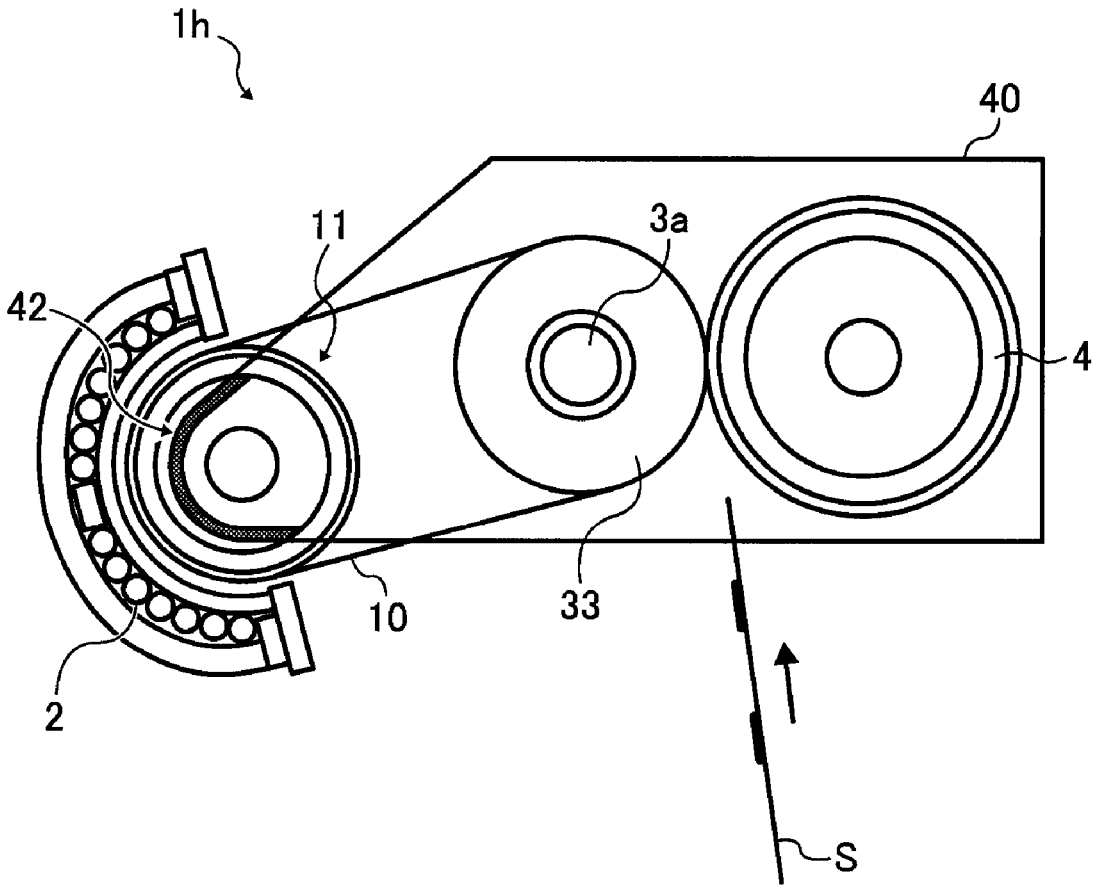
FIG. 28 shows (according to an example embodiment of the present invention) a schematic cross-sectional view of another fixing unit according to an example embodiment.

FIG. 28 shows another fixing unit 1*h* according to an example embodiment, which may have a configuration substantially similar to the fixing unit 1*a* shown in FIG. 6.

As shown in FIG. 28, the fixing unit 1*h* may include the fixing belt 10 as heatable rotating member and the supporting frame 40 having the bending portion 42. As shown in FIG. 28, the bending portion 42 may be provided to a given perimeter area of the supporting frame 40, which faces the external coil 2.

Numerous additional modifications and variations are possible in light of the above teachings. It is therefore to be understood that within the scope of the appended claims, the disclosure of the present invention may be practiced otherwise than as specifically described herein.

What is claimed is:

1. An image forming apparatus, comprising:

a shaft;

a heatable rotating member, mounted for rotation on the shaft, for fixing an image on a recording medium, the heatable rotating member having a heat generating layer below a surface of the heatable rotating member, the heat generating layer being heatable via a magnetic flux;

a magnetic flux generator configured to generate the magnetic flux, the magnetic flux generator being provided proximal to the heatable rotating member; and a supporting frame having a shaft supporter configured to support an end of the shaft on which the heatable rotating member is mounted, the shaft supporter being positioned outside of an end portion of the magnetic flux generator, wherein the supporting frame has a bending portion, and the bending portion is formed on the supporting frame by bending an end portion of the supporting frame in an outward direction with respect to the rotating shaft of the heatable rotating member, and the bending portion is between the magnetic flux generator and the shaft.

2. A fixing unit comprising:

a shaft;

a heatable rotating member, mounted for rotation on the shaft, for fixing an image on a recording medium, the heatable rotating member having a heat generating layer below a surface of the heatable rotating member, the heat generating layer being heatable via a magnetic flux;

a magnetic flux generator configured to generate the magnetic flux, the magnetic flux generator being provided proximal to the heatable rotating member; and a supporting frame having a shaft supporter configured to support an end of the shaft on which the heatable rotating member is mounted, the shaft supporter being positioned outside of an end portion of the magnetic flux generator, wherein the heatable rotating member is a heating roller, and the fixing unit further including:

an endless belt configured to be extended by the heating roller;

a first roller configured to extend the endless belt with the heating roller; and a pressure applying member configured to press the endless belt with the first roller, the pressure applying member and first roller being used to sandwich the endless belt, and the pressure applying member, the first roller, and the endless belt form a fixing nip for fixing an image on a recording medium when the recording medium passes through the fixing nip.

3. An image forming apparatus comprising:

a fixing unit including, a shaft, a heatable rotating member, mounted for rotation on the shaft, for fixing an image on a recording medium, the heatable rotating member having a heat generating layer below a surface of the heatable rotating member, the heat generating layer being heatable via a magnetic flux, a magnetic flux generator configured to generate the magnetic flux, the magnetic flux generator being provided proximal to the heatable rotating member, and a supporting frame having a shaft supporter configured to support an end of the shaft on which the heatable rotating member is mounted, the shaft supporter being positioned outside of an end portion of the magnetic flux generator, wherein the heatable rotating member is a heating roller, and the fixing unit further including:

an endless belt configured to be extended by the heating roller;

a first roller configured to extend the endless belt with the heating roller; and a pressure applying member configured to press the endless belt with the first roller, the pressure applying member and first roller being used to sandwich the endless belt, and the pressure applying member, the first roller, and the endless belt form a fixing nip for fixing an image on a recording medium when the recording medium passes through the fixing nip.

4. A fixing unit comprising:

a heatable rotating member for fixing an image on a recording medium, the heatable rotating member having a heat generating layer heatable via a magnetic flux, the heatable rotating member including an endless belt;

a magnetic flux generator, having a coil, to generate the magnetic flux, the magnetic flux generator being provided proximal to the heatable rotating member;

a first roller to extend the endless belt;

a second roller to extend the endless belt with the first roller, the second roller being provided proximal to the magnetic flux generator;

a pressure applying member configured to press the endless belt with the first roller, the pressure applying member and the first roller being used to sandwich the endless belt, and the pressure applying member, the first roller, and the endless belt form a fixing nip for fixing an image on a recording medium when the recording medium passes through the fixing nip; and a supporting frame to support at least the second roller to support the heatable rotating member, the supporting frame being positioned outside of an end of the magnetic flux generator in an axis direction of the second roller.

5. The image forming apparatus of claim 4, wherein the supporting frame supports the magnetic flux generator.

6. The image forming apparatus of claim 5, wherein the magnetic flux generator is provided with a casing to encase the coil, and the supporting frame supports the casing outside of an end portion of the coil in an axis direction of the second roller.

7. The image forming apparatus of claim 6, wherein a portion of the supporting frame is engaged into a concaved portion on the casing.

8. The image forming apparatus according to claim 6, wherein the fixing unit further includes a shielding member, provided between the magnetic flux generator and the supporting frame, configured to shield the supporting frame from the magnetic flux generated by the magnetic flux generator.

9. An image forming apparatus comprising:

a fixing unit including, a heatable rotating member for fixing an image on a recording medium, the heatable rotating member having a heat generating layer via a magnetic flux, the heatable rotating member including an endless belt;

a magnetic flux generator, having a coil, to generate the magnetic flux, the magnetic flux generator being provided proximal to the heatable rotating member;

a first roller to extend the endless belt;

a second roller to extend the endless belt with the first roller, the second roller being provided proximal to the magnetic flux generator;

a pressure applying member configured to press the endless belt with the first roller, the pressure applying member and the first roller being used to sandwich the endless belt, and the pressure applying member, the first roller, and the endless belt form a fixing nip for fixing an image on a recording medium when the recording medium passes through the fixing nip; and a supporting frame to support at least the second roller to support the heatable rotating member, the supporting frame being positioned outside of an end of the magnetic flux generator in an axis direction of the second roller.

10. The image forming apparatus of claim 9, wherein the supporting frame supports the magnetic flux generator.

11. The image forming apparatus of claim 10, wherein the magnetic flux generator is provided with a casing to encase the coil, and the supporting frame supports the casing outside of an end portion of the coil in an axis direction of the second roller.

12. The image forming apparatus of claim 11, wherein a portion of the supporting frame is engaged into a concaved portion on the casing.

13. The image forming apparatus according to claim 11, wherein the fixing unit further includes a shielding member, provided between the magnetic flux generator and the supporting frame, configured to shield the supporting frame from the magnetic flux generated by the magnetic flux generator.

14. The image forming apparatus according to claim 13, wherein the shielding member contacts the shaft supporter of the supporting frame and the magnetic flux generator to regulate a gap between the supporting frame and the magnetic flux generator.

15. The image forming apparatus according to claim 9, wherein the supporting frame is made of any one of a metal material, a magnetic material, and a non-magnetic material.

16. The image forming apparatus according to claim 9, wherein the supporting frame has a support hole to be fitted with the rotating shaft of the heatable rotating member.

17. The image forming apparatus according to claim 16, wherein the supporting frame is provided with a reinforcement member around the support hole to support a weight of the heatable rotating member.

18. The image forming apparatus according to claim 9, wherein the supporting frame has a first portion, which is closer to the magnetic flux generator, and the heatable rotating member has a second portion, which is closer to the magnetic flux generator, and wherein the first portion is more distant from the magnetic flux generator compared to the second portion.

19. The image forming apparatus according to claim 9, wherein the heatable rotating member includes any one of a fixing roller, a fixing sleeve, a fixing belt, and the fixing unit further including:

a pressure applying member configured to contact the heatable rotating member to apply pressure to the heatable rotating member, wherein the heatable rotating member and the pressure applying member fix an image on a recording medium when the recording medium passes through a fixing nip formed between the heatable rotating member and pressure applying member.

* * * * *